US007028421B2

(12) United States Patent
Galeyev

(10) Patent No.: US 7,028,421 B2
(45) Date of Patent: Apr. 18, 2006

(54) ANATOMICALLY CORRECT SKATING BOOT

(76) Inventor: Felix Galeyev, 7215 18th Ave., Brooklyn, NY (US) 11204

( * ) Notice: Subject to any disclaimer, the term of this patent is extended or adjusted under 35 U.S.C. 154(b) by 233 days.

(21) Appl. No.: 10/810,177

(22) Filed: Mar. 29, 2004

(65) Prior Publication Data

US 2005/0210711 A1 Sep. 29, 2005

(51) Int. Cl.
*A43B 5/04* (2006.01)

(52) U.S. Cl. ..... 36/115; 36/118.2

(58) Field of Classification Search ..... 36/114, 36/115, 118.2; 280/841
See application file for complete search history.

(56) References Cited

U.S. PATENT DOCUMENTS

| | | | | |
|---|---|---|---|---|
| 3,535,800 | A * | 10/1970 | Rudolf | 36/118.2 |
| 3,659,361 | A * | 5/1972 | White, Sr. | 36/89 |
| 3,844,055 | A * | 10/1974 | Koyama et al. | 36/118.2 |
| 4,107,856 | A | 8/1978 | Bourque | |
| 4,382,342 | A * | 5/1983 | Spademan | 36/118.1 |
| 5,171,033 | A | 12/1992 | Olson | |
| 5,491,911 | A | 2/1996 | Chen | |
| 5,740,620 | A * | 4/1998 | Giese et al. | 36/118.2 |
| 5,909,885 | A | 6/1999 | Borel | |
| 6,098,317 | A * | 8/2000 | Lazzaroni | 36/118.2 |
| 6,168,172 | B1 * | 1/2001 | Meibock et al. | 280/11.221 |

FOREIGN PATENT DOCUMENTS

| | | |
|---|---|---|
| DE | 242028 | 8/1965 |
| FR | 722436 | 10/1942 |
| FR | 1321975 | 2/1963 |

* cited by examiner

*Primary Examiner*—Marie Patterson
(74) *Attorney, Agent, or Firm*—Boris Leschinsky

(57) ABSTRACT

A skating boot adapted to fit around the foot of the user and allowing adequate forward and backward motion of the upper portion relative to the lower portion. The boot is equipped with an inside joint and an outside joint connecting the upper portion and the lower portion together. Front and rear elastic covers complete the shape of the boot and are attached to both the upper portion and the lower portion. The joints comprise and inside and an outside concave sliding disks adapted to slidingly engage with corresponding retainers incorporated within the upper and lower portions. The position of the joints is preferably offset with the inside joint located higher and closer to the front of the boot than the outside joint to accommodate the anatomical structure of the human ankle. The boot has a smooth shape and encases the foot such that all skating maneuvers can be completed with ease while providing adequate ankle support and foot protection.

5 Claims, 4 Drawing Sheets

ANATOMICALLY CORRECT SKATING BOOT

BACKGROUND OF INVENTION

The present invention relates generally to skating boots. More particularly, the boot of the invention is adapted to anatomically fit the foot of the user and allows the user to perform a full range of motions needed in ice-skating, roller-skating, and roller-blading. The boot of the invention may be optionally used as a skiing boot and for other athletic activities.

Skating presents a number of challenges for the motion of the foot of the user. An ideal skating boot must allow certain motions while restricting others and supporting the ankle of the user. The following is a partial list of requirements for an ideal skating boot:

- It should completely surround and encase the toe, foot and the ankle joint of the user without any voids or protruding parts either inside or outside the boot. The foot in such a boot should feel like a "hand in glove".
- The boot should allow a full motion of the calf of the user forward and backward. At a minimum, the boot should permit a 20° forward bend and a 30° backward bend to be done with ease.
- The boot should prevent any sidewise movements of the foot and the calf of the user and fully support the ankle joint.
- The boot should look esthetically pleasing and smooth, without protruding parts.
- It should be light in weight.
- It should protect the foot and ankle of the user against trauma during various hits and falls.

Importantly, the design of the skating boot should accommodate the anatomical structure of the foot and ankle, and specifically the fact that the bones of the ankle joint are not protruding symmetrically on both the inside and the outside part of the foot. It is known that the inside bone location is slightly higher and slightly in front of the outside bone.

Many designs of the skating boots are known in the prior art. Some of them are quite flexible while others are entirely rigid.

Some examples of known designs are outlined below. None of them however, are believed to satisfy completely the above-enumerated requirements.

Bourque discloses a molded athletic boot in the U.S. Pat. No. 4,107,856. The boot is formed of a lower portion hinged to the upper portion. The lower portion includes an upstanding extension on each side of the forward instep portion to which flexible straps are secured. The extensions are crossed and the straps encircle the back of the boot.

The shortcomings of this and other similar boots come from the presence of the hinge, even if it is located about the ankle joint. Strictly speaking, the ankle is not a hinge. It does not have a narrow axis of rotation. Instead, the ankle joint has a rather complex wide bone structure protruding on both sides of the ankle at asymmetric locations. Bending the calf does not cause the bone to rotate or skin of the leg to shift in any substantial way. Ideal skating boot should therefore accommodate that anatomical feature with internal cavities for the bone on both sides and generally in a better way than just with a simple symmetrical hinge.

Two more examples of hinged boots are shown in the U.S. Pat. No. 5,171,033 by Olson et al and U.S. Pat. No. 5,909,885 by Borel. They suffer from the same main drawback associated with the presence of a hinge as the previously discussed skating boot design.

German Patent No. 722,436 by Berger discloses a shoe comprising a lower portion equipped with a wire arch and an upper portion equipped with the sliding means. The upper part is capable of sliding about the ankle of the user in a better way than the hinged design. However, because of the larger diameter of the wire arch, the front and rear portions of the shoe produce wrinkles as the calf is bent forward and backward. That can be seen with clarity on FIG. 2 and FIG. 3 of the drawings. Provisions are needed to compensate for that wrinkling effect.

Finally, the Austrian Patent No. 242,028 shows a connection between a lower and upper portion of the boot to be made as a pair of sliding concave disks. The disks are still joined together with a hinge although this design has some advantages of having a better anatomical shape than others.

The need therefore still exists for a skating boot satisfying the above mentioned requirements having a simple and easy to manufacture design.

SUMMARY OF THE INVENTION

Accordingly, it is an object of the present invention to overcome these and other drawbacks of the prior art by providing a novel skating boot having provisions for anatomically correct bending of the calf of the user forward and backward while preventing any side bends thereof.

Another object of the invention is to provide a skating boot providing trauma protection and fully supporting the ankle of the user.

It is yet another object of the invention to provide a skating boot with provisions for complete surrounding the foot of the user without any voids, especially in the area of the ankle joint.

It is yet another object of the present invention to provide a skating boot having a smooth external surface.

It is yet another object of the invention to provide a skating boot accommodating the asymmetrical nature of the human bones forming an ankle joint of the foot.

It is a further object of the present invention to provide a skating boot having a simple design adapted for inexpensive manufacturing.

The skating boot of the invention comprises a lower portion, a middle portion and an upper portion. The middle portion comprises a wide diameter joint means independently connecting the lower and the upper portion therebetween with an appropriate offset to accommodate the asymmetric nature of a human ankle joint. They provide the boot with the ability for the upper portion to slide and articulate about the lower portion. The middle portion also includes front and rear elastic segments to complete the smooth surface of the boot. In one embodiment, such elastic segments are pre-stretched to avoid wrinkles during the bend of the calf of the user.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION OF THE PREFERRED EMBODIMENTS OF THE INVENTION

A detailed description of the present invention follows with reference to accompanying drawings in which like elements are indicated by like reference letters and numerals.

Figure 1:
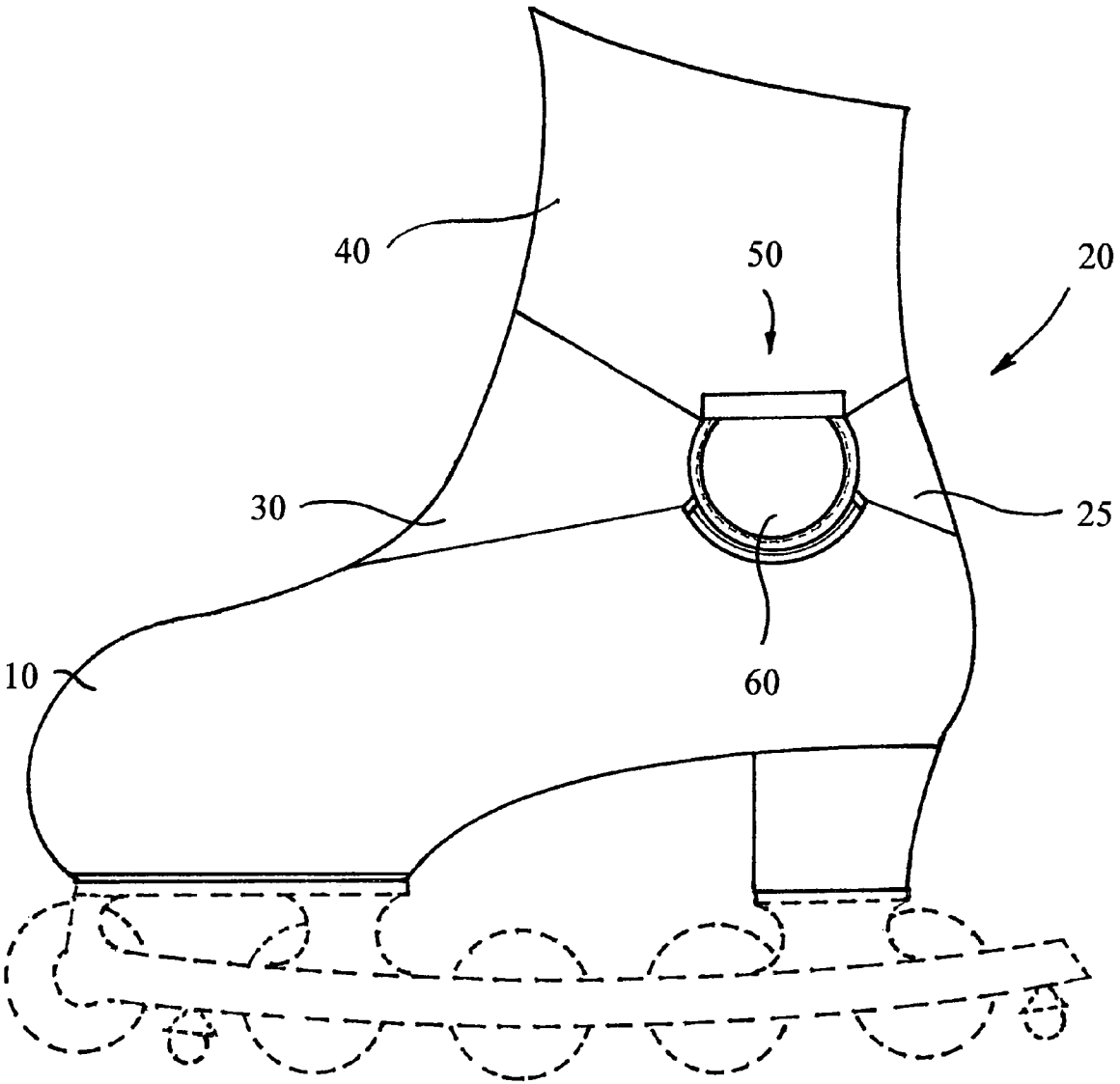
FIG. 1 is a general view of the skating boot of the invention from the inside of the foot.

FIG. 1 illustrates a general view of the roller skate with the skating boot of the invention. It consists of a lower portion 10 shaped to substantially encase the toe and the heel of the foot of the user and having provisions for attaching a skate or a roller assembly; the upper portion 40 encasing the lower calf; and the middle portion 20 surrounding the ankle area of the foot. The middle portion 20 in turn consists of a joint means 50, front elastic cover 30, and back elastic cover 25.

The lower and the upper portion are typically made of an appropriately shaped or molded polymer such as polyurethane or a similar plastic material. The thickness is chosen to insure sufficient stiffness of these two portions to protect the foot of the user and provide enough ankle support.

Figure 2:
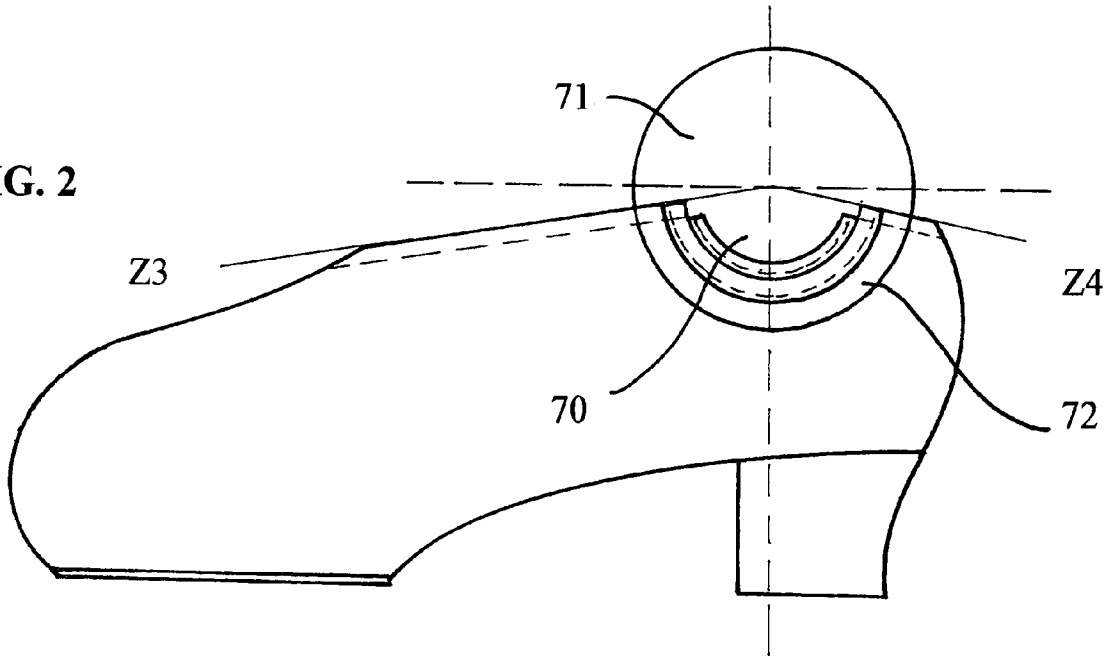
FIG. 2 is a view of the lower part of the skating boot of the invention showing the detail of the lower sliding part of the boot as seen from the outside part of the foot.
Figure 7:
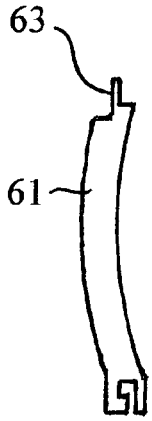
FIG. 7 is the cross-section view of the inside sliding disk.
Figure 8:
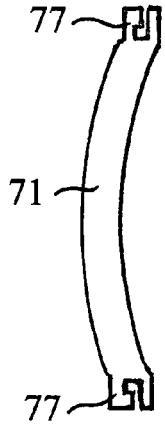
FIG. 8 is the cross-section view of the outside sliding disk.

The joint means 50 comprises an inside joint 60 and an outside joint 70 (shown on FIG. 2). Both joints 60 and 70 include wide diameter concave sliding disks 61 and 71 shown respectively in cross-section on FIGS. 7 and 8. They are made of a polymer similar to that of the boot itself or another low friction material. Importantly, both the radius of curvature and the actual size of the inside sliding disk 61 are smaller than that of the outside sliding disk 71 to accommodate the corresponding difference in diameters of the inside and outside bones of the human ankle joint. Preferably, the diameter of the inside disk ranges from about ⅜ inch to 2,5 inches while the diameter of the outside disk ranges from about ½ inch to about 3 inches. The inside disk 61 has a flat top portion 62 for reasons that would be explained in more detail below. Both disks are oriented to protrude away from the boot when assembled to allow for some space for the bones of the human ankle.

Figure 3:
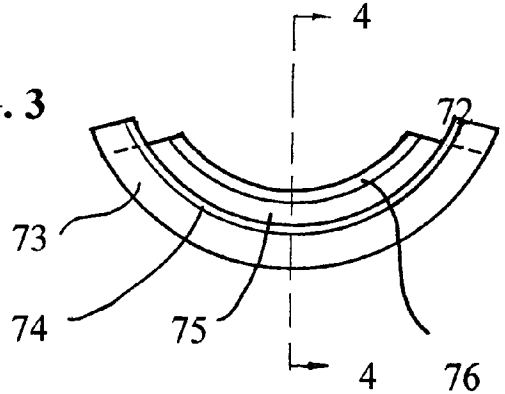
FIG. 3 is a close-up of that inside sliding part shown in FIG. 2.
Figure 4:
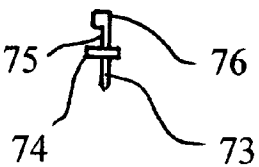
FIG. 4 is a view of the cross-section from FIG. 3 as indicated on the drawing.

The design of the sliding joints 60 and 70 will now be explained in detail. FIG. 2 shows the lower portion of the boot of the invention as seen from the outside of the foot. It shows the outside sliding disk 71 assembled with the retainer 72 of the lower portion 10. The detail of the retainer 72 is shown on FIG. 3 and FIG. 4. It has a generally round segment shape and consists of a vertical base 73 attached to the boot. The base 73 supports a horizontally oriented curved rail 74. The purpose of rail 74 is to support the corresponding detail of the sliding disk 71. A vertical slide 75 extends from the rail 74 and contains a stopper 76.

The outside sliding disk 71 has an peripheral detail 77 with an internal shape corresponding to that of the elements 74, 75, and 76. When assembled onto the boot by snapping it in place or by another appropriate attachment method, the sliding disk 71 is retained by the retainer 72 while allowing it to slide forward and backward.

The upper outside portion of the boot (not shown on the drawings) also contains retaining provisions for attachment to the outside sliding disk 71. The retainer of the upper portion is made to be the same as the retainer of the lower portion. The upper peripheral detail of the sliding disk 71 is correspondingly made to be the same as its lower detail 77.

The inside joint 60 is made in a similar way as the outside joint 70 but with one important distinction. While the lower inside retainer 62 and the lower part of the inside sliding disk 61 are the same as the corresponding elements of the lower outside retainer 72 and the outside sliding disk 71, the upper retainer 65 has a straight horizontal slider 64. The upper section of the inside sliding disk 61 has a straight horizontal rib 63 shaped so as to fit inside the slider 64. The entire upper portion of the inside joint 60 is therefore adapted for the inside sliding disk 61 to slide back and forth in the upper portion 40 of the boot of the invention. That is done in contrast to the rotation ability of the outside joint 70 as will be explained in more detail below.

The length or perimeter of the engaging elements of both inside and outside sliding disks 61 and 71 are made somewhat shorter than the corresponding elements of retainers. This is done to permit a 20° forward bend and a 30° backward bend of the upper portion relative to the lower portion of the boot without engaging parts of the sliding disks protruding beyond the corresponding retainers.

Figure 5:
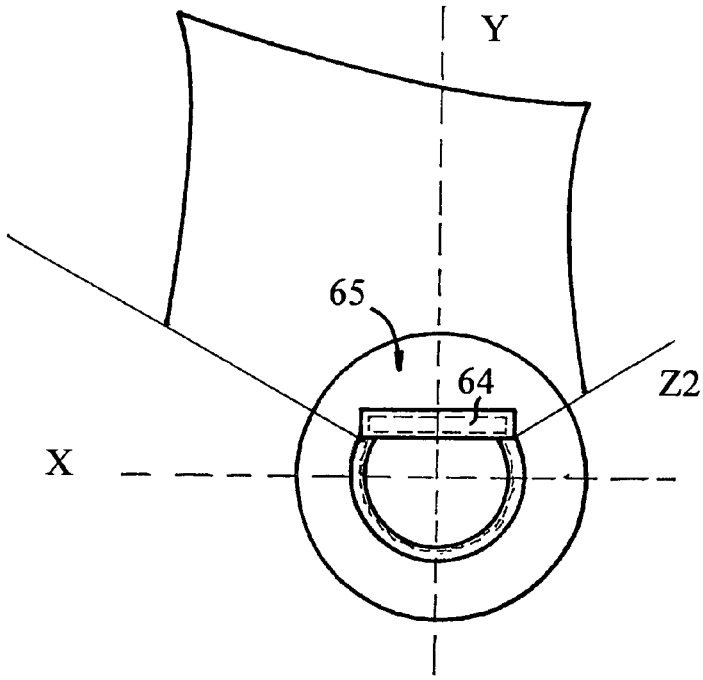
FIG. 5 is a view of the upper portion of the boot assembled with the inside sliding disk as seen from the inside view of the foot.
Figure 6:
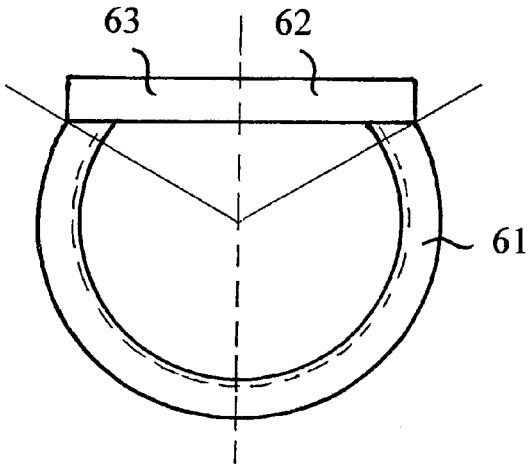
FIG. 6 is the enlarged detailed view of the inside sliding disk.

To complete the description of the elements of the skating boot of the invention, attention is called now to the front 30 and rear 25 elastic covers. They are both made out of elastic material such as rubber or polymer and attached along their periphery to the corresponding parts of the lower and upper portions of the skating boot, shown as lines Z1, Z2, Z3, and Z4 on FIGS. 2, 5 and 9 to encase the rest of the ankle and foot areas. The angle between Z1 and Z3 as well as between Z2 and Z5 should be sufficiently large to accommodate the needed angle of calf bent. Their function is to complete the cover of the foot of the user and allow the upper portion to bend relative to the lower portion of the boot with little or no wrinkles. In one preferred embodiment, both elastic covers are sufficiently pre-stretched when assembled so that they do not wrinkle at all as the boot is bent towards them.

The need for such elastic covers is dictated also by another important feature of the invention, namely the offset of the location of the inside joint 60 to the outside joint 70. Expanding and contracting of the elastic covers compensate mechanical offset created by the bend of the boot as will be explained below.

Figure 9:
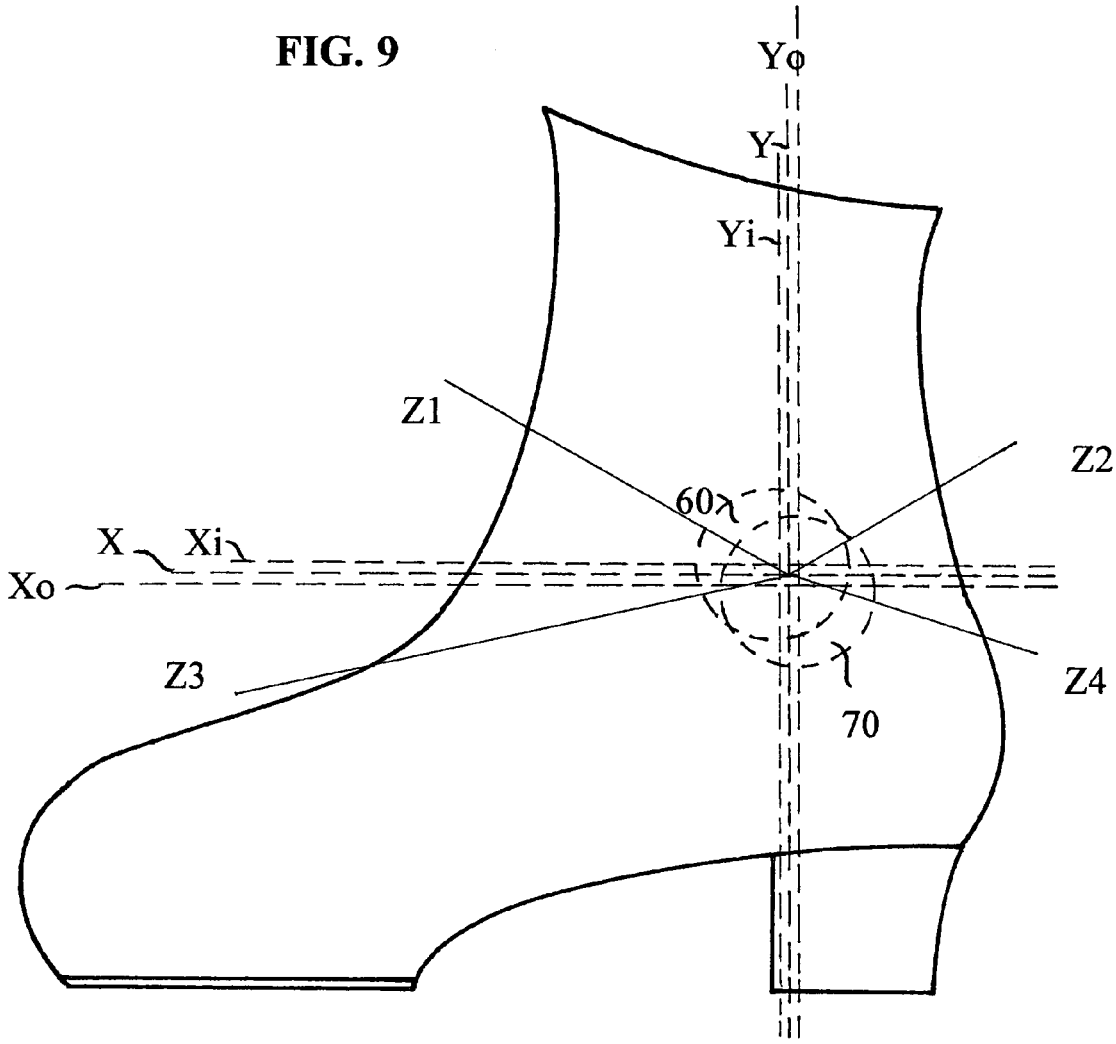
FIG. 9 is a general view of the boot showing a relative offset in position of the inside and outside joint of the boot.

FIG. 9 illustrates the concept behind an offset of the location of the joints 60 and 70 relative to each other and the rest of the boot of the invention. It is known that the inside bone of the ankle joint is located higher and slightly to the front than the outside bone. To compensate for that offset, the inside joint 60 is also located higher and towards the front of the boot relative to the outside joint. Vertical axis Yo and Yi indicate the corresponding centers of rotation of the outside and the inside joints. In the middle between them is located the vertical axis Y for the entire boot. In a similar manner, horizontal axis Xi is shown higher for the inside joint 60 as opposed to the axis Xo for the outside joint, defining the axis X between them for the entire boot. The intersection of the X and Y axes defines the general point of rotation of the boot, and lines Z1 through Z4 defining the borders of the elastic covers 30 and 25 are all drawn through that point.

Note that the drawings and the above description are pertaining to the right boot. The left boot is made exactly the same but with a symmetrical design.

In use, the skating boot functions in the following way. Once a wearer puts the skate on, the boot accommodates the foot of the user so that both the inside and the outside bones of the ankle joint are closely surrounded by the elements of the boot. In a straight orientation, the boot supports the ankle on both sides and protects the foot of the user. When the calf of the user is bent forward, the upper portion articulates forward relative to the lower portion of the boot so that the outside joint rotably slides forward. At the same time, the inside joint allows for the lower part to rotably slide in a similar manner as the outside lower part, while the upper inside retainer 62 of the boot slides forward on a straight line along the inside sliding disk 61. That complex motion allows compensating for the offset in the positions of the centers of the inside and outside joints. Elastic covers 30 and 25 also stretch to accommodate for the motion of the upper portion of the boot with little or no wrinkles depending on the angle of the bend.

A similar motion happens when the user bends his calf backward—all joints slide rotably except for a straight backward motion of the retainer 62 along the upper straight section of the inside sliding disk 61.

The design of the skating boot of the invention allows for complex motions of the skaters while still providing for firm side support of the ankle, all in a smooth outside shape without any protruding parts.

Although the invention herein has been described with respect to particular embodiments, it is understood that these embodiments are merely illustrative of the principles and applications of the present invention. For example, one can envision using the boot as a skiing boot since the movements of a cross-country skier are somewhat similar to that of the skater. it can also be used for other athletic and non-athletic activities in which it is needed to prevent any side movements of the ankle joint while preserving the ability for movements forward and backward. It is therefore to be understood that numerous modifications may be made to the illustrative embodiments and that other arrangements may be devised without departing from the spirit and scope of the present invention as defined by the appended claims.

What is claimed is:

1. A boot comprising:

a lower portion shaped to encase a toe and a heel of a user's foot, said lower portion including an inside lower retainer means and an outside lower retainer means incorporated therewith, an upper portion shaped to encase a lower calf, said upper portion including an inside upper retainer means and outside upper retainer means incorporated therewith, and a middle portion connecting said lower and said upper portions, said middle portion shaped to encase an ankle joint of the foot, said middle portion comprising a wide diameter joint means to rotably connect said upper portion to said lower portion, a front elastic cover and a rear elastic cover, said elastic covers shaped to surround the ankle area of the foot, said covers attached to said lower and upper portions of said boot, said joint means comprising an inside joint means having an inside sliding disk and an outside joint means having an outside sliding disk, said inside sliding disk adapted to slidingly engage with said upper inside retainer and said lower inside retainer, said outside sliding disk adapted to rotably and slidingly engage with said upper outside retainer and said lower outside retainer.

2. The boot as in claim 1, wherein said front and said rear elastic covers are pre-stretched.

3. The boot as in claim 1, wherein said inside joint means located asymmetrically higher and closer to a front of the boot than said outside joint means.

4. The boot as in claim 3, wherein said inside sliding disk having a flat top portion and said corresponding inside upper retainer having a straight slider, whereby said upper portion adapted to slide in said slider along said inside sliding disk to compensate for an asymmetric location of said inside and said outside joint means.

5. The boot as in claim 1, wherein said inside and outside sliding disks are substantially concave and protruding away from said boot.

* * * * *